US008486491B2

(12) United States Patent
Satoh et al.

(10) Patent No.: US 8,486,491 B2
(45) Date of Patent: Jul. 16, 2013

(54) PROCESS FOR PRODUCING SURFACE CONDITIONED ALUMINUM CASTINGS

(75) Inventors: Hiroyuki Satoh, Nagoya (JP); Masaki Watanabe, Hiratsuka (JP); Takao Ogino, Hiratsuka (JP)

(73) Assignee: Henkel AG & Co. KGaA, Duesseldorf (DE)

( * ) Notice: Subject to any disclaimer, the term of this patent is extended or adjusted under 35 U.S.C. 154(b) by 355 days.

(21) Appl. No.: 12/772,606

(22) Filed: May 3, 2010

(65) Prior Publication Data

US 2010/0317260 A1 Dec. 16, 2010

Related U.S. Application Data

(63) Continuation of application No. PCT/JP2008/068430, filed on Oct. 10, 2008.

(30) Foreign Application Priority Data

Nov. 1, 2007 (JP) ..... 2007-285491

(51) Int. Cl.
*B05D 3/00* (2006.01)

(52) U.S. Cl.
USPC ..... 427/327; 427/299; 148/240; 148/500; 148/502

(58) Field of Classification Search
USPC ..... 427/327
See application file for complete search history.

(56) References Cited

FOREIGN PATENT DOCUMENTS

| | | | |
|---|---|---|---|
| JP | 56136978 | A | 10/1981 |
| JP | 1246370 | A | 10/1989 |
| JP | 7188956 | A | 7/1995 |
| JP | 11131254 | A | 5/1999 |
| JP | 11181587 | A | 7/1999 |
| JP | 2003119572 | A | 4/2003 |
| JP | 200476024 | A | 3/2004 |
| JP | 20062229 | A | 1/2006 |
| JP | 2007107069 | A | 4/2007 |
| JP | 2007204835 | A | 8/2007 |
| WO | 03074761 | A1 | 9/2003 |

OTHER PUBLICATIONS

International Search Report of PCT International Publication WO 2009/057435 A1, published Jul. 5, 2009.

*Primary Examiner* — David Turocy
(74) *Attorney, Agent, or Firm* — Mary K. Cameron

(57) ABSTRACT

A process for producing surface conditioned aluminum castings, comprising a step of applying to aluminum castings an alkaline surface conditioning liquid containing at least one organic builder and/or one chelating agent, wherein the alkaline surface conditioning liquid used in the step has a surface conditioning activity (CD; mol/l) in the range of $0.05 \leqq CD \leqq 2.3$ and a coefficient of gloss (CE; g/mol) in the range of $2.8 \leqq CE \leqq 90$.

9 Claims, No Drawings

PROCESS FOR PRODUCING SURFACE CONDITIONED ALUMINUM CASTINGS

CROSS-REFERENCE TO RELATED CASES

This application is a continuation under 35 U.S.C. Sections 365(c) and 120 of International Application No. PCT/JP2008/068430, filed Oct. 10, 2008 and published on May 7, 2009 as WO 2009/057435, which claims priority from Japanese Patent Application Serial No. 2007-285491 filed Nov. 1, 2007, which are incorporated herein by reference in their entirety.

TECHNICAL FIELD

The present invention relates to a process for producing surface conditioned aluminum castings and a process for producing nonchromate-coated aluminum castings using the surface conditioned aluminum castings.

BACKGROUND OF THE INVENTION

Aluminum castings are lightweight and easily moldable and therefore have been used in various fields such as architectural members, decorative items, automobile and motorcycle parts and automobile wheels. They are, however, destined to undergo the problem of corrosion if the metal materials are used as they are. As such, coating is often carried out in order to secure corrosion resistance for finished products and to improve appearances of the finished products. When coating is carried out directly on the metal products, however, coating adhesion and/or corrosion resistance after coating as required in the market may not be satisfied. Therefore, surface treatment is performed before carrying out coating.

As such surface treatment, chromate treatment process, for example, is a treatment process which provides excellent adhesion and corrosion resistance. However, hexavalent chromium used for such chromate treatment has traditionally been noted with its carcinogenicity. Therefore, in case of reaction type chromate treatment, such measures are taken as closing a rinsing step after chromate treatment. Also, application type chromate treatment has been in practical use, where drying is carried out instead of rinsing after chromate treatment. Any type of chromate treatment tends to be avoided, however, because coated films contain hexavalent chromium so that the possibility of chromium eluting from the films may not completely be eliminated and because of the problem in operational safety and health environment at the time of surface treatment.

Patent Reference 1: Japanese Unexamined Patent Publication 2007-107069

Patent Reference 2: WO2003/074761

Patent Reference 3: Japanese Unexamined Patent Publication 2004-76024

Patent Reference 4: Japanese Unexamined Patent Publication Hei 7-188956

Patent Reference 5: Japanese Unexamined Patent Publication Hei 11-181587

Patent Reference 6: Japanese Unexamined Patent Publication 2006-2229

Then, surface treatment of aluminum castings through nonchromate conversion treatment not containing hexavalent chromium may be contemplated. When aluminum castings are treated before coating through such nonchromate conversion treatment, however, sufficient coating adhesion or corrosion resistance after coating may not be obtained. For aluminum wheels in particular, in addition to heavy surface fouling due to casting and a wide variation in degree of such fouling, coating adhesion and/or corrosion resistance after coating are likely to decline even when shot blasting is carried out, because shot powders adhere to the aluminum wheels. Therefore, means for securing their stable performances have been strongly hoped for.

Patent Reference 1 describes that, prior to nonchromate treatment of aluminum-based substrates, treating with a strong alkaline aqueous solution or alkaline electrolyzed water enables to improve coating adhesion and/or corrosion resistance after coating. According to the experiments carried out by the present inventors, however, it was found that defective treated surface appearances or defective film performances after coating may arise in thus treated aluminum castings. As such, the present invention has a primary object of providing a means for avoiding defective treated surface appearances or defective film performances after coating in techniques for non-chromate conversion treatment of aluminum castings even with a surface conditioning step using a strong alkali before the conversion treatment.

Further, the present inventors have found that continued use of the strong alkali solution of Patent Reference 1 caused variability in treated surface appearances and/or film performances after coating among aluminum castings. As such, the present invention has an object of providing a means for avoiding variability in treated surface appearances and/or film performances among aluminum castings in production lines.

As a result of conducting a prior art search in relation to the present invention, the applicants have found, in addition to the above Patent Reference 1, Patent References 2 to 6 to be described below as being relevant to the present invention. However, each of the techniques described in the Patent References has a problem such that it is impossible to improve coating adhesion and corrosion resistance after coating when aluminum castings are coated or that material surfaces need to be sufficiently cleaned. Detailed discussion will be made below.

First, Patent Reference 2 discloses a surface treatment composition, a surface treatment liquid and a process for surface treatment to be used for depositing surface treatment films excellent in corrosion resistance without coating and corrosion resistance after coating on the surfaces of aluminum, aluminum alloys, magnesium or magnesium alloys using a treatment liquid which will not release wastes such as sludge and does not contain ingredients hazardous to the environment such as hexavalent chromium, and such metal materials excellent in corrosion resistance without coating.

Patent Reference 3 discloses a process for conversion treatment with a conversion treatment agent consisting of zirconium and/or titanium ions, fluorine ions, phosphate ions and a soluble epoxy resin, excellent in corrosion resistance and adhesion, and suitably applicable to aluminum substrates such as aluminum die castings AC-4C and AC-4-CH, and 5000 series and 6000 series aluminum alloys, without using chromium.

According to these inventions, it is understood that adhesion and corrosion resistance after coating of aluminum-based materials can be improved. According to the working examples of these inventions, however, as a precondition for the conversion treatment processes, the aluminum-based materials need cleaning through a degreasing step or the like. When the material surface happens to be uncleaned due to some anomaly on the surface, it is unlikely that targeted coating performances can be provided. Further, in addition to the anomaly on the material surface, when a degreasing agent or the like suffers reduced performances due to aging of the degreasing agent etc., it is unlikely that targeted film coating performances can be accomplished.

Patent Reference 4 discloses a process for surface treatment of Mg containing aluminum alloy sheets for automobile bodies, characterized by washing treatment in a weakly alkaline alkali solution at pH 12 or lower in surface treatment before application of a low viscosity oil for press molding the Mg containing aluminum alloy sheets for automobile bodies. This invention alleges that, uniformity of zinc phosphate films can be improved without decreasing moldability in the case when a low viscosity oil is applied by washing treatment for from 10 to 120 s using an alkali solution of which pH is from 9 to 12 and etching rate is 4 $g/m^2$ or less when immersed in the alkali solution for 300 s. This invention relates to, however, a procedure for the purpose of improving uniformity of zinc phosphate films over the surface of aluminum sheet materials after press working and differs from the present invention in its objects, materials to be treated and treatment steps.

Patent Reference 5 discloses an alkaline liquid detergent for metals storable at room temperature, excellent in detergency and liquid stability with age, which contains a concentrated alkali component but contains a concentrated detersive active ingredient equal to or higher than the solubility in a uniformly emulsified and dispersed condition. With this method, room temperature storable, one-pack type detergents having detergency equal to or higher than that of conventional products can be produced at a low cost. This invention relates to, however, a procedure for producing stable, one-pack type detergents and differs from the present invention in its objects, materials to be treated, treatment steps and treatment methods.

Patent Reference 6 discloses a detergent exhibiting high etching performance on aluminum and its alloys in a very short time. This invention alleges that it is possible to provide excellent detergency with an alkali metal, a maleic acid copolymer and a hydroxyl-carboxylic acid. This invention relates to, however, a procedure for the purpose of exhibiting high etching performance in a very short time, maintaining the high etching performance at relatively low pH ranges compared to conventional products, increasing the allowable amount of aluminum ions and keeping the generated sludge level at a low level, and differs from the present invention in its objects and treatment steps.

SUMMARY OF THE INVENTION

As a result of energetic studies, the present inventors have found that defective treated surface appearances or defective film performances after coating when an alkaline surface conditioning liquid is used are caused by ingredient (B) of carbonates, bicarbonates and aluminum salts having absorbed aluminum eluted from aluminum castings and/or carbon dioxide gas in the air, which increase in the liquid with the use of the liquid. The present inventors have also proposed surface conditioning activity and coefficient of gloss as parameters for indexing them, which are to be controlled in predetermined ranges, and have found the problems regarding defective treated surface appearances or defective film performances after coating can be solved, and finally accomplished the present invention successfully.

The present invention (1) relates to a process for producing surface conditioned aluminum castings, including a step of applying to aluminum castings an alkaline surface conditioning liquid which contains at least one organic builder and/or chelating agent, where the alkaline surface conditioning liquid used in the step has a surface conditioning activity (CD; mol/l), which is a value of content in terms of sodium hydroxide as measured according to a first method to be described below (CA; mol/l) minus a value of content in terms of sodium hydroxide as measured according to a second method to be described below (CB; mol/l) and a coefficient of gloss (CE; g/mol), a value of concentration of the at least one organic builder and/or chelating agent (CC; g/l) divided by the surface conditioning activity (CD; mol/l), both of which are set to respectively satisfy the conditions:

$$0.05 \leqq CD \leqq 2.3 \text{ and}$$

$$2.8 \leqq CE \leqq 90,$$

the first method giving a value measured in terms of acid consumption amount based on JIS K 0102.15.2, and the second method giving the total of a value obtained by first measuring an amount of inorganic C by inorganic carbon measurement of TOC measurement based on JIS K 0102.22 and then converting it into a value in terms of sodium hydroxide as $Na_2CO_3$ and a value obtained by first measuring an aluminum concentration based on JIS K 0102.58 and then converting it into a value in terms of sodium hydroxide as $NaAl(OH)_4$.

The present invention (2) relates to the process according to the invention (1) where the surface conditioning activity (CD) and the coefficient of gloss (CE) are respectively controlled in a certain range during continual production of the surface conditioned aluminum castings.

The present invention (3) relates to the process according to the invention (2) further including a step of replenishing the alkaline surface conditioning liquid with an alkaline metal component in order to control the surface conditioning activity (CD) in the certain range and a step of replenishing the alkaline surface conditioning liquid with the at least one organic builder and/or chelating agent in order to control the coefficient of gloss (CE) in the certain range.

The present invention (4) relates to the process according to any one of the inventions (1) to (3), where the organic builder is one or more selected from the group consisting of (C1) vinyl polymers and/or vinyl copolymers obtained from one or more selected from the group consisting of at least acrylic acid, methacrylic acid, maleic acid, vinylsulfonic acid, styrenesulfonic acid and alkaline metal salts thereof as water-soluble vinyl monomers and (C2) vinyl copolymers obtained from one or more selected from the group consisting of at least acrylic acid, methacrylic acid, maleic acid, vinylsulfonic acid, styrenesulfonic acid and alkaline metal salts thereof as water-insoluble vinyl monomers, in which the molar ratio between the water-soluble vinyl monomers and the water-insoluble vinyl monomers is water-soluble vinyl monomers/(water-soluble vinyl monomers+water-insoluble vinyl monomers)=0.2 to 1.0; where the chelating agent is one or more selected from the group consisting of tartaric acid, citric acid, malic acid, glycolic acid, gluconic acid, heptogluconic acid, ethylenediaminetetraacetic acid, diethylenetriaminepentaacetic acid, L-glutaminediacetic acid and alkaline metal salts thereof.

The present invention (5) relates to a process for producing nonchromate-coated aluminum castings, including a step of subjecting to nonchromate conversion treatment the surface conditioned aluminum castings obtained by the process according to any one of the inventions (1) to (4).

The present invention (6) relates to the process according to the invention (5) further including a step of shot blasting the aluminum castings before applying the alkaline surface conditioning liquid to the aluminum castings or a step of shot blasting the aluminum castings after applying the alkaline surface conditioning liquid to the aluminum castings.

The terms as used in CLAIMS and DESCRIPTION will now be described. The terms "content in terms of sodium hydroxide as measured according to a first method" and "content in terms of sodium hydroxide as measured according to a second method" do not mean that it is necessary to measure according to the first and second methods in real controls. Therefore, methods for measurement different from the first and second methods may be implemented in real controls. Even if values based on such methods for measurement are outside the ranges of the present invention, therefore, when the values obtained for a liquid according to the first and second methods are within the ranges of the present invention, the liquid will fall within the scope of the present invention. The term "surface conditioning" means preliminary conditioning of metal surfaces for providing surfaces of aluminum castings suitable for surface treatment.

DETAILED DESCRIPTION OF THE INVENTION

An alkaline surface conditioning liquid (composition, physical properties), a process for producing surface conditioned aluminum castings using the alkaline conditioning liquid (process for surface conditioning aluminum castings) and applications of the surface conditioned aluminum castings (process for producing nonchromate conversion treated aluminum castings, process for producing coated aluminum castings) according to the best mode of the present invention will be described below in order. What is described below is of the best mode and is not intended to limit the technical scope of the present invention.

Composition of Alkaline Surface Conditioning Liquid

The alkaline surface conditioning liquid according to the best mode contains (A) at least one alkaline metal ingredient, (B) at least one ingredient selected from the group consisting of carbonate, bicarbonate and aluminum salt and (C) at least one ingredient selected from the group consisting of an organic builder and a chelating agent. Each of the ingredients will be described in detail below. While the ingredients (A) to (C) are specified as solid stuffs from which water as a solvent has been removed, they will be present as partially or wholly dissociated in the alkaline surface conditioning liquid.

Ingredient (A): Alkaline Metal

As the ingredient (A), at least one selected from the group consisting of hydroxides, silicates, aluminates, phosphates and condensed phosphates of sodium and potassium can be used. The concentration of the alkaline metals as the ingredient (A) as sodium and/or potassium is preferably from 1 to 10 g/L and more preferably from 2 to 50 g/L. Concentration below 1 g/L may make the process inefficient because it can require lengthy treatment at high temperatures due to insufficient etching performance, while concentration above 100 g/L may make the process less cost-effective because the effect becomes saturated.

Ingredient (B): at Least One Selected from the Group Consisting of Carbonate, Bicarbonate and Aluminum Salt The ingredient (B) is at least one selected from the group consisting of carbonate, bicarbonate and aluminum salt. The ingredient may originally be contained in the surface conditioning liquid or may come to be contained in the surface conditioning liquid as it accumulates in the liquid along with the use of the liquid (carbonates and/or bicarbonates accumulate being derived from carbon dioxide in the atmosphere and aluminum salts accumulate being derived from aluminum castings). Preferred concentrations are, for example, from 0.5 to 4.0 g/l for addition of $Na_2CO_3$ as a carbonate and from 10 to 200 g/l for addition of $NaAl(OH)_4$ as an aluminum salt, using as a guideline the equilibrium concentrations and the like depending on the applied lines. Examples of carbonates and/or bicarbonates include sodium carbonate, potassium carbonate, aluminum carbonate, ammonium bicarbonate, baking soda and potassium bicarbonate. Examples of aluminum salts include sodium aluminate and potassium aluminate.

Ingredient (C): at Least One Selected from the Group Consisting of an Organic Builder and a Chelating Agent The ingredient (C) is a ingredient for imparting a good surface appearance, that is, good surface smoothness and designability, to surface conditioned aluminum castings. For the ingredient (C), preferred as organic builders are one or more selected from (C1) vinyl polymers and/or vinyl copolymers obtained from one or more selected from the group consisting of at least acrylic acid, maleic acid, vinylsulfonic acid, styrenesulfonic acid and alkaline metal salts thereof as water-soluble vinyl monomers and (C2) vinyl copolymers obtained from one or more selected from the group consisting of at least acrylic acid, maleic acid, vinylsulfonic acid, styrenesulfonic acid and alkaline metal salts thereof as water-insoluble vinyl monomers, in which the molar ratio between the water-soluble vinyl monomers and the water-insoluble vinyl monomers is water-soluble vinyl monomers/(water-soluble vinyl monomers+water-insoluble vinyl monomers) =0.2 to 1.0.

For the ingredient (C), preferred as chelating agents are one or more selected from the group consisting of tartaric acid, citric acid, malic acid, glycolic acid, gluconic acid, heptogluconic acid, ethylenediaminetetraacetic acid, diethylenetriaminepentaacetic acid, L-glutaminediacetic acid and alkaline metal salts thereof.

The content of the ingredient (C) is preferably at a concentration of 1 to 50 g/L and more preferably at a concentration of 1 to 20 g/L. Contents of the ingredient (C) below 1 g/L are not preferred because they are not sufficient to suppress hydrolyzed products generated by a sudden change in pH at the interface between aluminum castings and the surface conditioning liquid caused by an etching reaction produced when the aluminum castings are contacted with the surface conditioning liquid and because they are not sufficient to complement aluminum ions eluted into the surface conditioning liquid and alloy component ions contained in the aluminum castings, with degraded performance of surface treatment at subsequent steps. Also, concentration above 50 g/L may make the process less cost-effective because the effect becomes saturated.

Other Optional Ingredients

The surface conditioning liquid according to the best mode may contain an ordinary surface active agent used typically for reducing surface tension of an aqueous solution and improving wettability against aluminum casting surfaces. Surface active agents are not particularly limited and one or more selected from nonionic, anionic, cationic and amphoteric surface active agents can be used. Preferably, one or more selected from nonionic surface active agents and, more preferably, one or more selected from nonionic surface active agents in which HLB=5 to 16 can optionally be used.

Physical Properties of Alkaline Surface Conditioning Liquid

The alkaline surface conditioning liquid according to the best mode has preferably a content of the ingredients (A) to (C) in terms of sodium hydroxide (CA) of 0.1 mol/L to 4.0 mol/L and a content of the ingredient (B) in terms of sodium hydroxide (CB) of 0.01 mol/L to 0.5 mol/L.

Also, the alkaline surface conditioning liquid according to the best mode needs to have a surface conditioning activity (CD) defined as the content in terms of sodium hydroxide (CA) minus the content in terms of sodium hydroxide (CB) of 0.05 mol/L to 2.3 mol/L. Also, the surface conditioning activity is preferably from 0.1 mol/L to 1.5 mol/L.

Further, the alkaline surface conditioning liquid according to the best mode needs to have a coefficient of gloss (CE) defined as the concentration of the ingredient (C) (CC; g/l) divided by the surface conditioning activity (CD; mol/l) of 2.8 g/mol to 90 g/mol. When the CE is lower, the appearances after surface conditioning will degrade, while the CE is too high, economic disadvantages will arise. Also, the coefficient of gloss is preferably from 5 g/mol to 60 g/mol.

Process for Producing Surface Conditioned Aluminum Castings

A process for producing surface conditioned aluminum castings according to the best mode will now be described. The process will be described with respect to aluminum castings as a raw material, production processes (in particular, surface conditioning step) and surface conditioned aluminum castings as a final product in the mentioned order.

Aluminum Castings

Aluminum castings to be used in the process according to the best mode are not particularly limited; examples of which include alloy castings of aluminum and at least one element selected from the group consisting of copper, magnesium, zinc, iron, silicon and the like in which aluminum makes up 50% by mass or more. Specific examples include aluminum alloys of AC 1 to 8 (A to C) and ADC 1 to 12 and the like according to JIS which are used in architectural materials, decorative items, automobile and motorcycle parts and aluminum wheels. The present invention is particularly effective with AC 1 to 8 used for aluminum wheels and the like thereamong.

Typically, the aluminum castings are subjected to shot blasting for removing burrs and the like produced during casting or to cutting for cutting part of the aluminum castings. Such shot blasting and/or cutting may be carried out before or after the surface conditioning step described below, or may even be omitted.

Production Processes (in Particular, Surface Conditioning Step)

The process for producing surface conditioned aluminum castings according to the best mode essentially includes a step of applying an alkaline surface conditioning liquid to the aluminum castings and optionally includes other steps such as a shot blasting step and a cutting step for cutting part of the aluminum castings as mentioned above. Steps other than the surface conditioning are well known in the art and their specifics are clear even if they are not otherwise specified in DESCRIPTION so that those skilled in the art may implement such steps and the scope thereof may be well-defined. Here, "applying" may include spraying the surface conditioning liquid, immersing in the surface conditioning liquid, flowing the surface conditioning liquid and combinations thereof.

First, the temperature of the surface conditioning liquid for the surface conditioning treatment is preferably from 30 to 80° C. Below 30° C., surface conditions suitable for necessary and sufficient surface treatment may not be obtained, while above 80° C. may make the process less cost-effective because the effect will become saturated. More preferably, the temperature is from 35 to 70° C. The time in contact between the surface conditioning liquid and aluminum castings is not particularly limited, but is preferably from 1 second to 10 minutes. Surface conditions suitable for necessary and sufficient surface treatment may not be obtained in the case of less than 1 second, while the effect will become saturated in the case of more than 10 minutes, with disadvantageous productivity. Preferably, the time of contact is from 30 seconds to 5 minutes.

In order to avoid defective treated surface appearances or defective film performances after coating, control must be exercised so that the surface conditioning activity may be in the range of from 0.05 to 2.3 mol/L and the coefficient of gloss may be in the range of from 2.8 to 90 mol/L as described above. As the liquid is used repeatedly, however, as mentioned above, the ingredient (B) of carbonates, bicarbonates and aluminum salts will increase, absorbing or otherwise obtaining aluminum eluted from the aluminum castings and carbon dioxide gas in the air, and simultaneously the ingredient (C) will decrease, possibly falling outside the specified range. In such cases, defective treated surface appearances or defective film performances after coating may arise. Therefore, the surface conditioning activity and the coefficient of gloss need to be periodically monitored and the ingredient (A) and/or the ingredient (C) need to be replenished so that they may not fall outside the ranges described above. Further, even when the levels are within the ranges, variability will inevitably arise in treated surface appearances and/or film performances after coating among products on the production lines. Therefore, the surface conditioning activity and the coefficient of gloss need to be periodically monitored and the ingredient (A) and/or the ingredient (C) are preferably be replenished periodically so that the surface conditioning activity and the coefficient of gloss may always remain at certain levels. Such certain levels may be determined for each line depending on line characteristics and quality requirement levels. In general, smaller levels are more preferred. They are preferably within ±30%, more preferably within ±20% and even more preferably within ±10%.

Surface Conditioned Aluminum Castings

The surface conditioned aluminum castings obtained according to the present process are disposed to have little defective treated surface appearances or defective film performances after coating (design and appearance retaining performances). Also, the surface conditioned aluminum castings obtained according to the present process possess drastically improved coating adhesion and corrosion resistance after coating. Thus, by setting the CD and CE at the beginning of treatment within the specified levels as described above, the surface conditioned aluminum castings provide excellent performances (treated surface appearances and performances after coating). Further, by controlling the CD and CE during continual treatment, each of multiple surface conditioned aluminum castings produced on the line has the excellent performances as mentioned above, with no variability in treated surface appearances and/or performances after coating. Specifically, as shown in Table 2 of EXAMPLES, the first 10 pieces of surface conditioned aluminum castings showed very excellent treated surface appearances. It was found, however, that when the liquid was used repeatedly without controlling the CD and CE, the original performances was not be maintained. Therefore, predetermined excellent results were obtained by controlling the width between CD control and CE control of the liquid within smaller ranges values along with the treatment.

Uses of Surface Conditioned Aluminum Castings (Process for Producing Nonchromate Conversion Treated Aluminum Castings and Process for Producing Coated Aluminum Castings)

The surface conditioned aluminum castings obtained according to the present process can be used as a raw material for producing nonchromate conversion treated aluminum castings and coated aluminum castings. Specifically, nonchromate conversion treated aluminum castings and/or coated aluminum castings are produced via steps such as shot blasting, barrel polishing or brush polishing step for removing mold release agents used during casting and burrs or the like generated during casting, a cutting step for cutting part of the surface of castings for obtaining required dimensional accuracy and smoothness, a pretreatment step for nonchromate conversion treatment through which nonchromate conversion treated aluminum castings are produced and a coating step through which coated aluminum castings are produced. In addition, the produced castings may optionally be with heat treatment. Also, between each of the steps, general-purpose steps such as rinsing, acid pickling and degreasing steps may be incorporated. Each of the steps will be described below.

First, a shot blasting step may be carried out before or after the surface conditioning step as described above. The shot blasting step may not be mandatory. Materials to be used for the shot blasting are not particularly limited. In view of cost, ease in handling and the like, iron-containing particles, such as stainless, iron and steel may be generally used and, in addition, particles made of metals, such as zinc, zinc alloy, aluminum and aluminum alloy particles, particles made of ceramics, such as silica, alumina, zirconia, silicon carbide and silicon nitride particles as well as organic resin particles such as various plastic particles may be used.

Next, a cutting step is a step of cutting part of aluminum castings for the purpose of dimensional accuracy, surface smoothness, designability and the like. As mentioned above, the cutting step may also be carried out either before or after the surface conditioning step. When the cutting step is carried out before the surface conditioning treatment, the subsequent surface treatment will have to be more restricted, because, when the surface conditioning step is carried out after the cutting operation, in order not to impair dimensional accuracy, surface smoothness, designability and the like, conditions of use for the surface conditioning treatment will inevitably be more restricted.

Next, a nonchromate conversion step, includes a conversion treatment where hexavalent chromium is free. Such nonchromate conversion treatment is not limited as long as it contains no hexavalent chromium, examples of which include a conversion treatment liquid containing an aqueous solution containing a vanadium compound and at least one compound selected from the group consisting of titanium salts, zirconium salts and zinc salts (Japanese Unexamined Patent Publication Sho 56-136978) and a conversion treatment agent containing V ions, Zr ions, $PO_4$ ions and effective F ions and adjusted to pH 1.5 to 4.0 (Japanese Unexamined Patent Publication Hei 1-246370, Japanese Unexamined Patent Publication Hei 7-310189 and Japanese Unexamined Patent Publication Hei 11-131254).

EXAMPLES

Effects of the present invention will be specifically described with reference to Examples and Comparative Examples below, to which the present invention is not limited in any way.

Steps

Basic treatment steps are shot blasting, cutting, surface conditioning, surface treatment and coating in this order. Conditions for surface conditioning are different between Examples and Comparative Examples, which will subsequently be referred to. First, conditions common to Examples and Comparative Examples are described here.

(1) Sample material: AC4C series aluminum cast sheets: 70 mm×150 mm (2) Shot blasting: Using iron shots, surface roughness was adjusted to from 5 to 10 μm.

(3) Cutting: Surface roughness was adjusted to from 1 to 5 μm.

(4) Surface treatment: Degreasing, rinsing, acid pickling, rinsing, conversion treatment, rinsing, pure water rinsing and drying (120° C., 20 minutes) were carried out in the above order.

(4-1) Degreasing: Using a commercially available alkaline degreasing agent FC-359 (Nihon Parkerizing Co., Ltd.) spraying was carried out at 50° C. for 2 minutes.

(4-2) Acid pickling: Using a commercially available acid pickling agent PL-5552 (Nihon Parkerizing Co., Ltd.) spraying was carried out at 50° C. for 1 minute.

(4-3) Conversion treatment: Using a commercially available zirconium-based, hexavalent chromium-free conversion treatment agent (Nihon Parkerizing Co., Ltd.), spraying was carried out at 45° C. for 1 minute.

(5) Coating: Using a commercially available powder coating EVACLAD 5600 (Kansai Paint Co., Ltd.) baking was carried out at a film thickness of 100 μm at 160° C. for 20 minutes, before applying a commercially available solvent-based coating Magicron ALC Base Clear (Kansai Paint Co., Ltd.) at a film thickness of 30 μm. Then, using a commercially available solvent-based coating Magicron ALC clear (Kansai Paint Co., Ltd.) coating was carried out at a film thickness of 30 μm, before baking at 140° C. for 20 minutes.

The compositions and physical properties of the surface conditioning liquids used in Examples 1 to 14 and Comparative Examples 1 to 4 are shown in Table 1. Production of the surface conditioning liquids was carried out by adding to water a predetermined amount of ingredient A, a predetermined amount of ingredient B and a predetermined amount of ingredient C. Also, measurements of CD and CE of the treatment liquids were carried out respectively according to a first method and a second method. A sample was immersed in each surface conditioning liquid warmed at 70° C. to carry out surface conditioning treatment for one minute. Thereafter, the conversion treatment, coating and the like as described above were carried out and then surface appearance evaluations and coating performance examinations after surface conditioning were carried out for each coated sample. The results are shown in Table 1. Also, each method for testing is described below.

Appearance Evaluations after Surface Conditioning

●: surface is uniformly glossy.

○: surface is uniformly glossy (but the glossiness is more or less inferior to ●).

Δ: more or less uneven.

x: severely uneven.

For the testing of Table 2, treatment was continued while changing the status of CD and CE controls of the predetermined treatment liquids and surface treated appearances of the $10^{th}$, $100^{th}$ to $110^{th}$ and $200^{th}$ to $210^{th}$ pieces of the aluminum castings were investigated.

Coating Performance Testing $1^{st}$ ADH: Primary Adhesion Test

Using a sharp cutter knife, 100 grids were crosscut at a spacing of 2 mm and each grid was removed with an adhesive tape to observe the condition of the grid.

$2^{nd}$ ADH: Water-Resistant Secondary Adhesion Test

Coated sheets were immersed in deionized water at 40° C. for 240 hours. Thereafter, using a sharp cutter knife, 100 grids were crosscut at a spacing of 2 mm and each grid was removed with an adhesive tape to observe the condition of the grid.

SST: Salt Spray Test

A coated sheet crosscut with a sharp cutter knife was sprayed with a 5% aqueous NaCl solution for 840 hours (according to JIS-Z-2371) and, after spraying, the maximum width of blistering on each side from the crosscut point was measured.

CASS Test

A coated sheet crosscut with a sharp cutter knife was sprayed with a 5% aqueous NaCl, copper chloride and acetic acid solution for 240 hours (according to JIS-Z-2371) and, after spraying, the maximum width of blistering on each side from the crosscut point was measured.

Coating Performance Evaluations $1^{st}$ ADH: Primary Adhesion Test

Number of removal after tape removal $2^{nd}$ ADH: Water-Resistance Secondary Adhesion Test Number of removal after tape removal SST: Salt Spray Test Maximum width of blistering on each side 0.0 to 0.5 mm: ●

0.5 to 1.0 mm: ○

1.0 to 2.0 mm: Δ

2.0 mm≦: x

CASS Test

Maximum width of blistering on each side 0.0 to 1.5 mm: ●

1.5 to 3.0 mm: ○

3.0 to 5.0 mm: Δ

5.0 mm≦: x

Next, using the treatment liquids of Examples 2, 6 and 9, differences in performance were evaluated between when CD and CE were controlled and when they were not. The results are shown in Table 2.

TABLE 1

| Examples/ Comparative Examples | Components added: Component A (g/l) NaOH | KOH | Component B (g/l) $Na_2CO_3$ | $NaAl(OH)_4$ | Component C (g/l) Na gluconate | Na tartrate | PA-Na | Na polymaleate | Parameters CA | CB | CC g/l | CD mol/L | CE Ratios |
|---|---|---|---|---|---|---|---|---|---|---|---|---|---|
| Example 1 | 2 | | 0.6 | 23.7 | | | | 1 | 0.25 | 0.20 | 1 | 0.05 | 16.00 |
| Example 2 | 40 | | 0.9 | 94.8 | | | | 10 | 1.88 | 0.76 | 10 | 1.13 | 8.89 |
| Example 3 | 60 | | 1.2 | 118.5 | | | | 20 | 3.20 | 0.95 | 10 | 2.25 | 4.44 |
| Example 4 | 2 | | 1.1 | 19.0 | | | | 4.5 | 0.28 | 0.17 | 4.5 | 0.11 | 42.35 |
| Example 5 | 80 | | 0.6 | 165.9 | | | | 5 | 3.38 | 1.31 | 6 | 2.08 | 2.89 |
| Example 6 | 40 | | 0.6 | 123.3 | 5 | | 5 | | 2.05 | 0.97 | 10 | 1.07 | 9.34 |
| Example 7 | 40 | | 0.9 | 109.0 | 5 | | | 5 | 1.95 | 0.87 | 10 | 1.08 | 9.26 |
| Example 8 | 40 | | 1.1 | 104.3 | 10 | | | | 1.87 | 0.84 | 10 | 1.04 | 9.66 |
| Example 9 | 45 | 5 | 2.83 | 104.3 | 0 | 4 | 0 | 10 | 2.25 | 0.87 | 14 | 1.38 | 10.14 |
| Example 10 | 45 | 5 | 2.83 | 104.3 | 0 | 3 | 2 | 10 | 2.26 | 0.87 | 15 | 1.39 | 10.78 |
| Example 11 | 30 | 10 | 2.83 | 71.111 | 5 | 0 | 0 | 5 | 1.62 | 0.61 | 10 | 1.01 | 9.91 |
| Example 12 | 30 | 0 | 2.83 | 71.111 | 5 | 0 | 0 | 5 | 1.44 | 0.61 | 10 | 0.83 | 12.05 |
| Example 13 | 30 | 0 | 2.83 | 71.111 | 2 | 1 | 4 | 4 | 1.47 | 0.61 | 11 | 0.86 | 12.79 |
| Example 14 | 40 | 0 | 3.679 | 123.26 | 1 | 0 | 10 | 0 | 2.14 | 1.03 | 11 | 1.11 | 9.91 |
| Comparative Example 1 | 0.5 | | 1 | 14.2 | | | | 0.1 | 0.14 | 0.13 | 0.1 | 0.01 | 7.27 |
| Comparative Example 2 | 100 | | 1.3 | 142.2 | | | | 25 | 3.95 | 1.14 | 25 | 2.81 | 8.89 |
| Comparative Example 3 | 40 | | 1.1 | 71.1 | | | | 1 | 1.69 | 0.58 | 1 | 1.01 | 0.99 |
| Comparative Example 4 | 50 | | 1.2 | 128.0 | | | | 100 | 3.52 | 1.02 | 100 | 2.5 | 40.00 |

| Examples/ Comparative Examples | Evaluations: Appearance after surface conditioning [*1] | Performance after coating (adhesion) | Performance after coating (corrosion resistance) | Ease of effluent treatment |
|---|---|---|---|---|
| Example 1 | ○ | ○ | ○ | ○ |
| Example 2 | ◎ | ◎ | ◎ | ◎ |
| Example 3 | ○ | ○ | ○ | ○ |
| Example 4 | ○ | ○ | ○ | ○ |
| Example 5 | ○ | ○ | ○ | ○ |
| Example 6 | ◎ | ◎ | ◎ | ◎ |
| Example 7 | ◎ | ◎ | ◎ | ◎ |
| Example 8 | ○ | ○ | ○ | ○ |
| Example 9 | ◎ | ◎ | ◎ | ◎ |
| Example 10 | ◎ | ◎ | ◎ | ◎ |
| Example 11 | ◎ | ◎ | ◎ | ◎ |
| Example 12 | ◎ | ◎ | ◎ | ◎ |
| Example 13 | ◎ | ◎ | ◎ | ◎ |
| Example 14 | ◎ | ◎ | ◎ | ◎ |
| Comparative Example 1 | Δ | X | X | ○ |
| Comparative Example 2 | Δ | Δ | Δ | ○ |
| Comparative Example 3 | X | ○ | ○ | ○ |
| Comparative Example 4 | ○ | ○ | ○ | Δ |

Component C: PA-NA→monosodium polyacrylate (Mw 1000), Na polymaleate→disodium polymaleate (Mw 5000 except Example 7, Mw 100000 for Example 7)

*1 Appearance after surface treatment, quality per 10 pieces of products

TABLE 2

| | Treatment solutions | CD control | CE control | First to 10th pieces | 100th to 110th pieces | 200th to 210th pieces |
|---|---|---|---|---|---|---|
| Example 15 | Example 2 | ±10% | ±10% | ◎ | ◎ | ◎ |
| Example 16 | Example 2 | ±20% | ±20% | ◎ | ○~◎ | ○~◎ |
| Example 17 | Example 2 | ±30% | ±30% | ◎ | ○ | ○ |
| Comparative Example 5 | Example 2 | ±more than 30% | ±more than 30% | ◎ | Δ~○ | Δ |
| Example 18 | Example 6 | ±10% | ±10% | ◎ | ◎ | ◎ |
| Example 19 | Example 6 | ±20% | ±20% | ◎ | ○~◎ | ○~◎ |
| Example 20 | Example 6 | ±30% | ±30% | ◎ | ○ | ○ |
| Comparative Example 6 | Example 6 | ±more than 30% | ±more than 30% | ◎ | Δ~○ | Δ |
| Example 21 | Example 9 | ±10% | ±10% | ◎ | ◎ | ◎ |
| Example 22 | Example 9 | ±20% | ±20% | ◎ | ○~◎ | ○~◎ |
| Example 23 | Example 9 | ±30% | ±30% | ◎ | ○ | ○ |
| Comparative Example 7 | Example 9 | ±more than 30% | ±more than 30% | ◎ | Δ~○ | Δ |

From the results above, it is clear that appearance retaining properties (defective treated appearances or defective film performances after coating in products, differences in appearance among products) can be accomplished by using aluminum castings surface conditioned using the surface conditioning liquid according to the present invention for subsequent nonchromate conversion and coating treatments and that excellent coating adhesion and corrosion resistance after coating can be retained without using hexavalent chromium-based conversion treatment agents.

The surface conditioned aluminum castings obtained by the surface conditioned aluminum castings according to the present invention hardly have defective treated surface appearances or defective film performances after coating in products even with nonchromate conversion treatment and, in addition, show excellent coating adhesion and corrosion resistance after coating. Therefore, they can be applied to various uses, with proper care for the environment.

What is claimed is:

1. A process for producing surface conditioned aluminum castings, comprising a step of applying to aluminum castings an alkaline surface conditioning liquid which comprises: at least one alkaline ingredient (A) selected from the group consisting of hydroxides, silicates, aluminates, phosphates and condensed phosphates Of sodium and potassium; at least one organic builder and/or one chelating agent, wherein the alkaline surface conditioning liquid has a surface conditioning activity "CD" in mol/l, "CD" being defined as a value "CA", in mol/l, of content in terms of sodium hydroxide as measured according to a first method, minus a value "CB", mol/l, of content in terms of sodium hydroxide as measured according to a second method;

and a coefficient of gloss "CE" in g/mol, "CE" being defined as a value "CC", in g/l, of concentration of the at least one organic builder and/or chelating agent, divided by the surface conditioning activity "CD", in mol/l, both of which are set to respectively satisfy conditions:

$$0.05 \leqq CD \leqq 2.3 \text{ and}$$

$$2.8 \leqq CE \leqq 90,$$

wherein the first method provides a value measured in terms of acid consumption amount based on JIS K 0102.15.2, and the second method provides a total of a value obtained by first measuring an amount of inorganic carbon by inorganic carbon measurement of TOC measurement based on JIS K 0102.22 and then calculating a value alkaline ingredient in terms of sodium hydroxide converted to $Na_2CO_3$ using the amount of inorganic carbon as amount of carbon present as $Na_2CO_3$ and a value obtained by first measuring an aluminum concentration based on JIS K 0102.58 and then calculating a value of alkaline ingredient in terms of sodium hydroxide converted to as $NaAl(OH)^4$ using the aluminum concentration as amount Of aluminum present as $NaAl(OH)_4$.

2. The process according to claim 1, wherein the organic builder is one or more selected from the group consisting of:

(C1) vinyl polymers and/or vinyl copolymers obtained from one or more components selected from the group consisting of acrylic acid, methacrylic acid, maleic acid, vinylsulfonic acid, styrenesulfonic acid and alkaline metal salts thereof as water-soluble vinyl monomers; and (C2) vinyl copolymers obtained from one or more components selected from the group consisting of at least acrylic acid, methacrylic acid, maleic acid, vinylsulfonic acid, styrenesulfonic acid and alkaline metal salts thereof as water-insoluble vinyl monomers, in which the molar ratio between the water-soluble vinyl monomers and the water-insoluble vinyl monomers is water-soluble vinyl monomers/(water-soluble vinyl monomers+water insoluble vinyl monomers) is in a range of 0.2 to 1.0;

wherein the chelating agent:. is one or more selected from the group consisting of tartaric acid, citric acid, malic acid, glycolic acid, glucosic acid, heptogluconic acid, ethylenediaminetetraacetic acid, diethylenetriaminepentaacetic acid, L-glutaminediacetic acid and alkaline metal salts thereof.

3. The process according to claim 1, wherein the surface conditioning activity "CD" and the coefficient of gloss "CE" are respectively controlled in a selected range during continual production of the surface conditioned aluminum castings.

4. The process according to claim 3, further comprising a step of replenishing the alkaline surface conditioning liquid with an alkaline metal component in order to control the surface conditioning activity "CD" in the selected range and a step of replenishing the alkaline surface conditioning liquid with the at least one organic builder and/or one chelating agent in order to control the coefficient of gloss "CE" in the selected range.

5. The process according to claim 4, Wherein the organic builder is one or more selected from the group consisting of:

(C1) vinyl polymers and/or vinyl copolymers obtained from one or more components selected from the group consisting of acrylic acid, methacrylic acid, maleic acid, vinylsulfonic acid, styrenesulfonic acid and alkaline metal salts thereof as water-soluble vinyl monomers; and (C2) vinyl copolymers obtained from one or more components selected from the group consisting of at least acrylic acid, methacrylic acid, maleic acid, vinylsulfonic acid, styrenesulfonic acid and alkaline metal salts thereof as water-insoluble vinyl monomers, in which the molar ratio between the water-soluble vinyl monomers and the water-insoluble vinyl monomers is water-soluble vinyl monomers/(water-soluble vinyl monomers+water insoluble vinyl monomers) is in the range of 0.2 to 1.0;

wherein the chelating agent is one or more selected from the group consisting of tartaric acid, citric acid, maiic acid, glycolic acid, gluconic acid, heptogluconic acid, ethylenediaminetetraacetic acid, diethylenetriamine-pentaacetic acid, L-glutaminediacetic acid and alkaline metal salts thereof.

6. The process for producing nonchromate-coated aluminum castings, comprising a step of subjecting to nonchromate conversion treatment the surface conditioned aluminum castings obtained by the process according to claim 1.

7. The process according to claim 6, further comprising a step of shot blasting the aluminum castings before applying the alkaline surface conditioning liquid to the aluminum castings or a step of shot blasting the surface conditioned aluminum castings after applying the alkaline surface conditioning liquid to the aluminum castings.

8. The process according to claim 1, wherein the alkaline surface conditioning liquid comprises:

(A) at least one selected from the group consisting of hydroxides, silicates, and aluminates of sodium and potassium;

(B) is at least one selected from the group consisting of carbonate, bicarbonate and aluminum salt.

9. The process according to claim 8, wherein the organic builder is one or more selected from the group consisting of:

(C1) vinyl polymers and/or vinyl copolymers obtained from One or more components selected from the group consisting of acrylic acid, methacrylic acid, maleic acid, vinylsulfonic acid, styrenesulfonic acid and alkaline metal salts thereof as water-soluble vinyl monomers; and (C2) vinyl copolymers obtained from one or more components selected from the group consisting of at least acrylic acid, methacrylic acid, maleic acid, vinylsulfonic acid, styrenesulfonic acid and alkaline metal salts thereof as water-insoluble vinyl monomers, in which the molar ratio between the water-soluble vinyl monomers and the water-insoluble vinyl monomers is water-soluble vinyl monomers/(water-soluble vinyl monomers+water insoluble vinyl monomers) is in a range of 0.2 to 1.0;

wherein the chelating agent is one or more selected from the group consisting of tartaric acid, citric acid, malic acid, glycolic acid, gluconic acid, heptogluconic acid, ethylenediaminetetraacetic acid, diethylenetriamine-pentaacetic acid, L-glutaminediacetic acid and alkaline metal salts thereof.

* * * * *